United States Patent [19]

Kim

[11] Patent Number: 4,958,481

[45] Date of Patent: Sep. 25, 1990

[54] BOX-CORDING APPARATUS

[76] Inventor: Sam H. Kim, 43-3, Myungju-dong, Kangneung-si, Kangwon-do, Rep. of Korea

[21] Appl. No.: 264,279

[22] PCT Filed: Feb. 19, 1988

[86] PCT No.: PCT/KR88/00005

§ 371 Date: Oct. 18, 1988

§ 102(e) Date: Oct. 18, 1988

[87] PCT Pub. No.: WO88/06124

PCT Pub. Date: Aug. 25, 1988

[30] Foreign Application Priority Data

Feb. 20, 1987 [KR] Rep. of Korea ..... 1987-1974

[51] Int. Cl.[5] ..... B65B 13/02; B65B 67/00

[52] U.S. Cl. ..... 53/592; 53/176; 53/390

[58] Field of Search ..... 53/176, 390, 587, 588, 53/590, 592; 100/14, 25, 27, 33 PB; 269/57, 309; 108/65, 90

[56] References Cited

U.S. PATENT DOCUMENTS

| | | | |
|---|---|---|---|
| 1,183,235 | 5/1916 | Rehfuss | 100/14 |
| 1,436,055 | 11/1922 | Shay | 100/14 X |
| 2,629,924 | 3/1953 | Kauper | 269/309 X |
| 2,634,532 | 4/1953 | Engrert | 100/14 |
| 3,182,586 | 5/1965 | Armington | 100/14 X |
| 4,355,496 | 10/1982 | Teates | 53/587 |

*Primary Examiner*—John Sipos

*Attorney, Agent, or Firm*—McAulay Fisher Nissen & Goldberg

[57] ABSTRACT

A box-cording apparatus used to cord up a packing box. The apparatus comprises a frame means having a base frame and support members slidably installed thereon, a driving means for moving the support members back and forth, and a frame rotating means having a shaft and a control means for the rotation of the shaft. The support members are bound together with parts of the box loaded on the base frame during the cording work and then pulled and received in the base frame, getting free from the corded parts of the box.

6 Claims, 7 Drawing Sheets

BOX-CORDING APPARATUS

BACKGROUND OF THE INVENTION

2. Field of the Invention

The present invention relates to a box-cording apparatus and, in particular, to a box-cording apparatus which is used to cord up a packing box after an article is put in it.

2. Description of the Prior Art

Typically, a packing box which contains an article must be corded up in a condition where the bottom thereof is held up, and, accordingly, in order to cord up one packing box completely, it must be picked up and put down several times. This is troublesome and inconvenient. Moreover, if the box is heavy, it is extremely difficult for one person to do it. Such cases not only require a lot of strength but also waste time and manpower.

SUMMARY OF THE INVENTION

It is an object of the present invention to provide a box-cording apparatus which overcomes or substantially reduces the above-drawback and by which a packing box can corded up single-handedly and also quickly and conveniently.

According to the present invention, there is provided a box-cording apparatus comprising a frame means which has a base frame and support members slidably installed in the base frame, a driving means which drives each of the support members backwards and forwards, and a frame rotating means which also has a shaft fixed to the base frame, a control means which controls the rotation of the shaft and a base which supports the shaft.

Thus, according to the present invention, a box to be corded up is put on the base frame after the support members installed therein are pushed in the proper directions and then the outer parts of the box are bound together with the support members consecutively. After the is completely bound, the support members are pulled into their original positions, becoming free from the bound cords.

For a better understanding of the present invention, reference is made to the following description and accompanying drawings while the scope of the invention will be pointed out in the appended claims.

BRIEF DESCRIPTION OF THE DRAWINGS

The present invention will now be described by way of illustrative example with reference to the accompanying drawings in which.

DETAILED DESCRIPTION OF THE PREFERRED EMBODIMENTS

Figure 1:
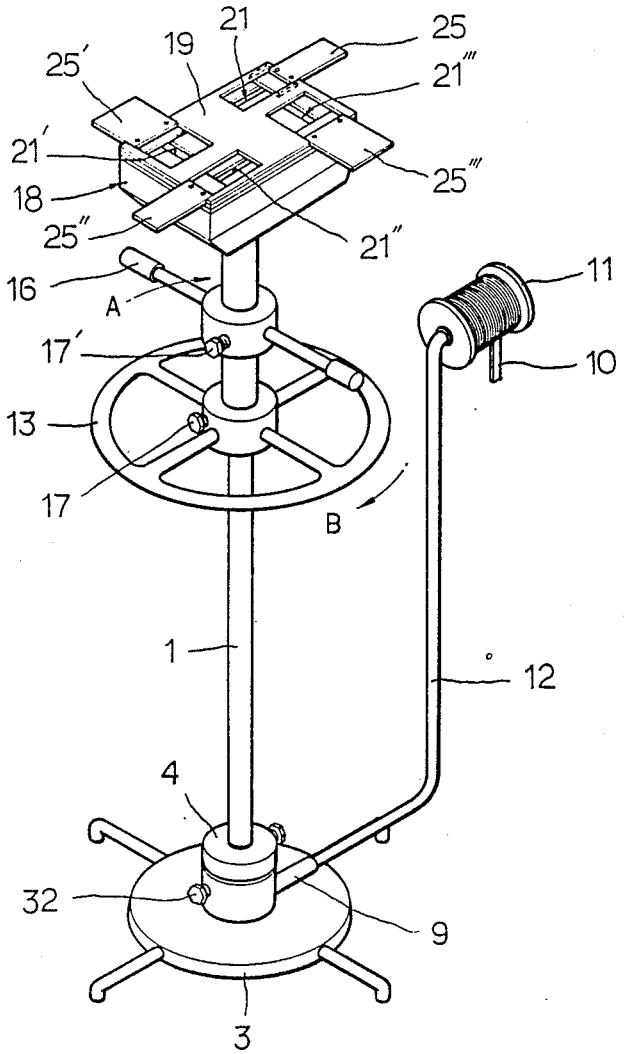
FIG. 1 is a perspective view of one embodiment of the box-cording apparatus according to the present invention.
Figure 2:
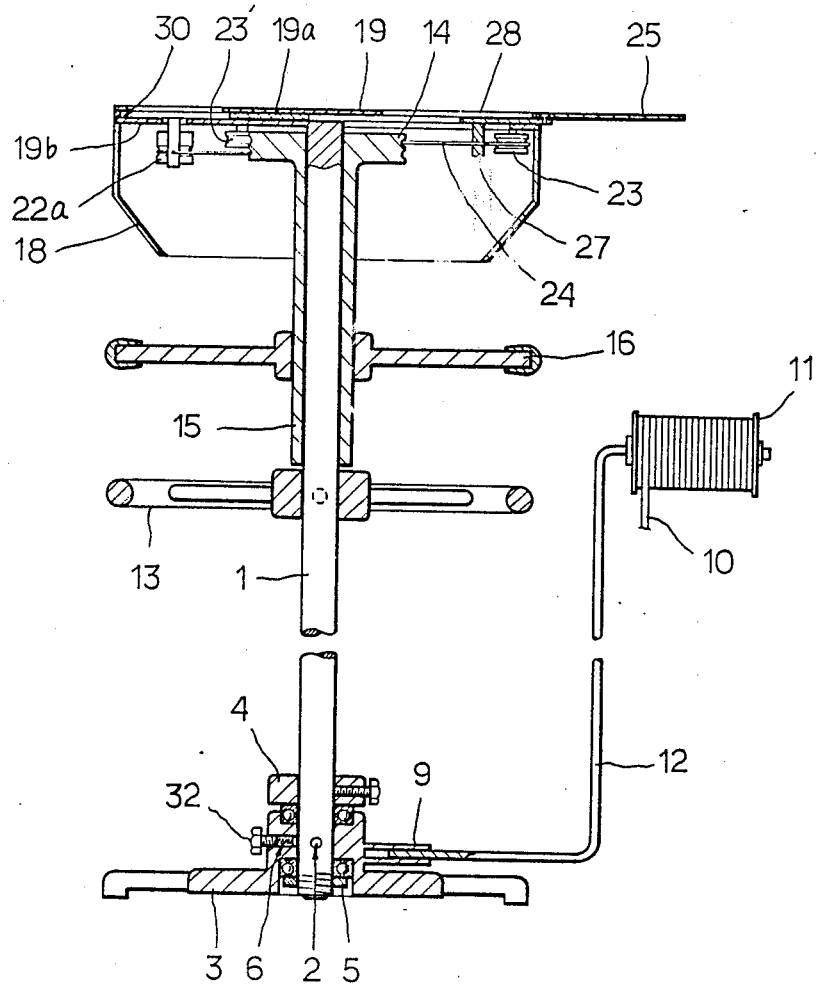
FIG. 2 is an enlarged elevation of the apparatus of FIG. 1.
Figure 3:
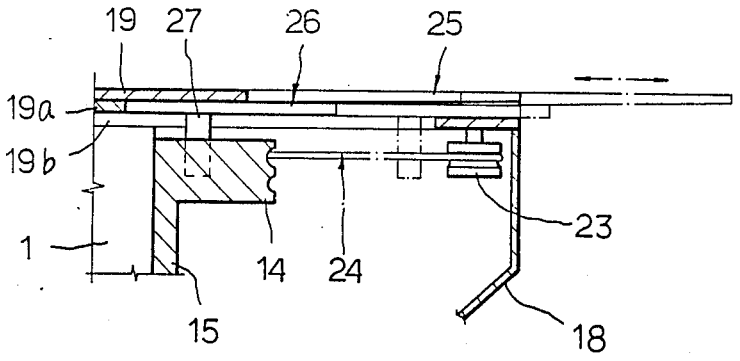
FIG. 3 is an enlarged vertical section of part of the apparatus of FIG. 1.

Referring to the drawings, FIGS. 1 and 2 illustrate that the lower part of the shaft 1 which has four catch holes 2 formed on its lower circumferential surface at intervals of an angle of 90° is inserted into a central opening of the base 3 and supported by a support ring 4 and a nut 5. On the upper part of the base 3, a lateral opening 6 is bored in the position which meets with one of the catch holes 2 and a ball 8 which is urged by means of a tension spring which is built-in so that part of the ball 8 is inserted into one of the catch holes 2. Thus, the shaft 1 comes to a stop whenever it rotates through an angle of 90°. On the one side of the base 3, a fixing pipe 9 to which a fixed pipe 12 having a roller 11 with a packing cord 10 is fixed may be installed in order to allow the user to use the packing cord 10 conveniently.

The upper part of the shaft 1 is inserted through a swivel pipe 15 which has a double-grooved pulley 14 formed at the end of its upper part, and thus the swivel pipe 15 is capable of moving round the shaft 1 by means of a control lever 16 fastened thereto by a bolt 17'.

Figure 4:
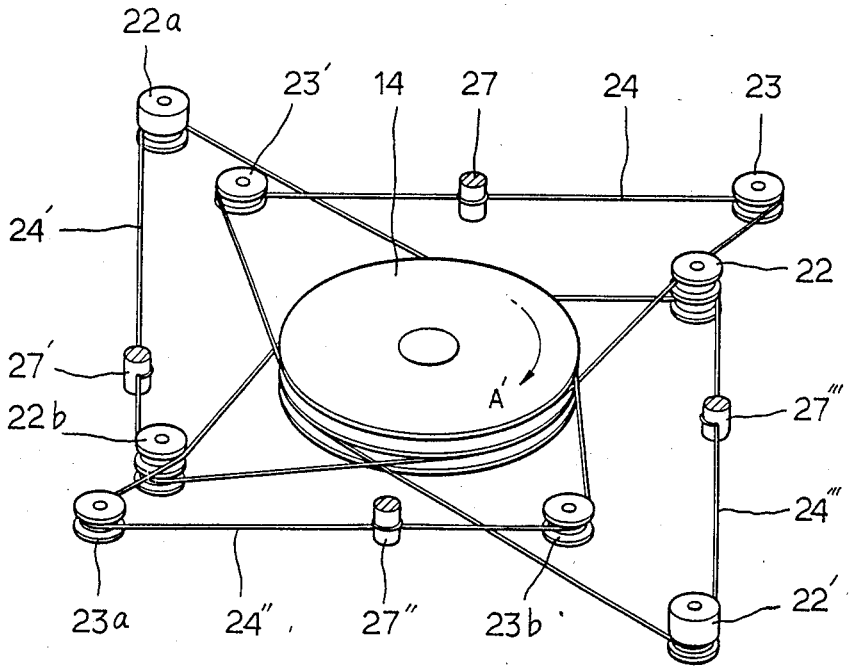
FIG. 4 is an enlarged perspective view showing a power-transmission means of the apparatus of FIG. 1.

On the other hand, the base frame 18 is made to maintain itself at a reasonable height as the upper end of the shaft 1 is fixed in the middle of the rear of a lower base plate 19*b* among base plates 19, 19*a*, 19*b*, which are also fixed on the upper part of the base frame 18, and therefore, it is possible to cord up a box 2 standing in a comfortable posture. On the four sides of the lower base plate 19*b*, guide holes 21, 21', 21'', 21''' for guiding the support members 25, 25', 25'', 25''' are provided. On the bottom thereof, thick support rollers 22, 22', 22*a*, 22*b* and thin support rollers 23, 23', 23*a*, 23*b* are installed at both sides of the guide holes as to rotate in a position symmetrical to each other and, as shown FIG. 4, steel wires 24, 24', 24'', 24''' are hung crosswise on the upper and lower grooves of the double-grooved pulley 14 through the support rollers. Guide pieces 26, 26', 26'', 26''' are firmly fixed to the bottom of the support members 25, 25', 25'', 25''' and guide pins 27, 27', 27'', 27''' are also connected to the bottom of the guide pieces 26, 26', 26'', 26'''. The guide pins 27, 27', 27'', 27''' have pinholes that the steel wires 24, 24', 24'', 24''' are put through and tied up with respectively.

The guide pins are placed through the guide holes 21, 21', 21'', 21''' in the lower base plate 19*b*. When the pulley 14 formed on the swivel pipe 15 rotates clockwise or counterclockwise by means of the control lever 16, the steel wires 24, 24', 24'', 24''' move in accordance with the rotating directions of the pulley 14 and thus the support members with which the steel wires are tied up respectively are capable of moving backwards and forwards within the guide holes 21, 21', 21'', 21'''.

On the base plates 19 and 19a which are to be attached in piles onto the base plate 19b, guide channels 28 and 29 are formed respectively. In the preferred embodiments, the width of the guide channels 29 on the middle base plate 19a is a little larger than that of the guide channels 28 on the upper base plate 19. Thus, since the base plates 19, 19a, 19b lie in piles, the inner surfaces of the guide channels 28 and 29 define guide groove 30 as shown in FIG. 2.

Thus, three sides of the guide pieces 26, 26', 26'', 26''' are slidably received within the guide grooves 30 and the support members 25, 25', 25'', 25''' are thereby made to come outside as shown in FIG. 1, while the pulley 14 rotates clockwise. On both sides of the entrance to the guide channels 29 on the base plate 19a, catching jaws 31 and 31' are respectively formed in order to catch both sides of the guide pieces, causing the support members not to fall from the guide channels 28 respectively.

Figure 5:
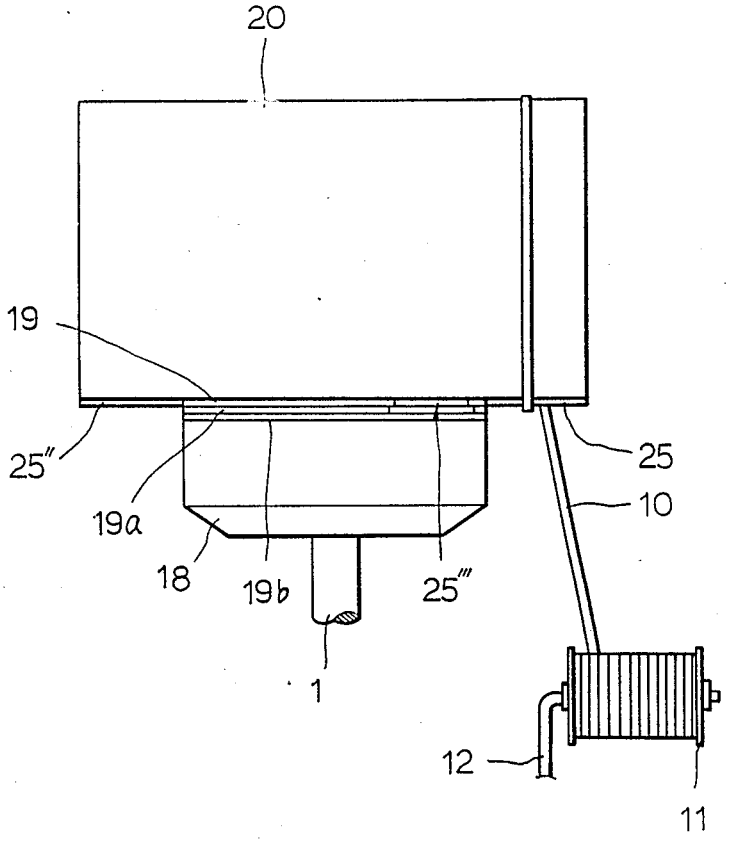
FIG. 5 is a partially enlarged elevation showing the manner in which the apparatus of FIG. 1 is used.
Figure 6:
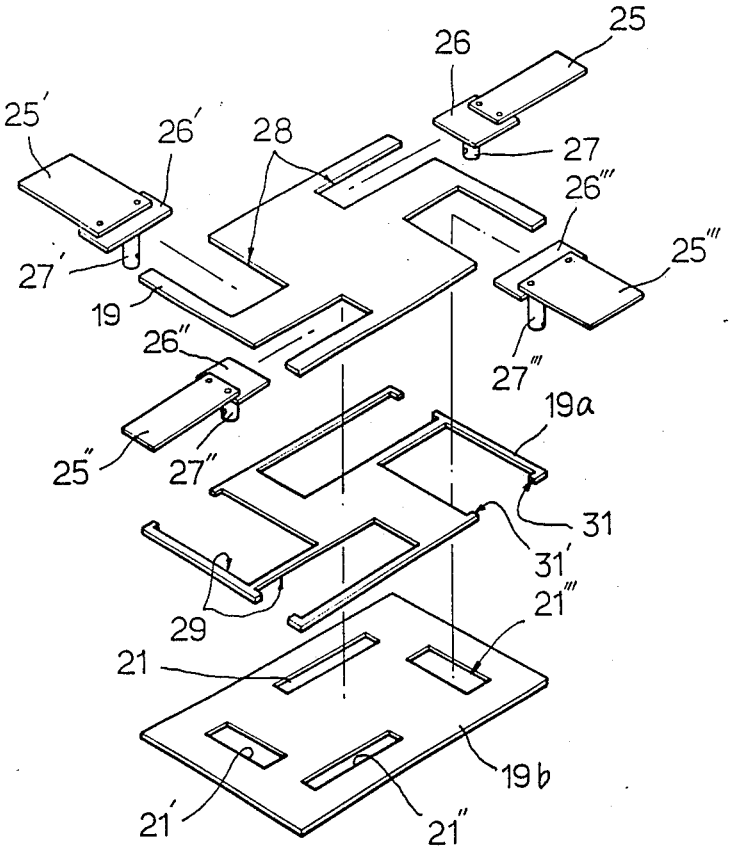
FIG. 6 is an exploded perspective view showing a frame means of the apparatus of FIG. 1.
Figure 7:
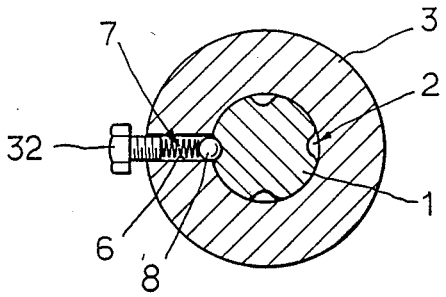
FIG. 7 is a cross-sectional view showing a control means for controlling the rotation of a shaft in the apparatus of FIG. 1.
Figure 8:
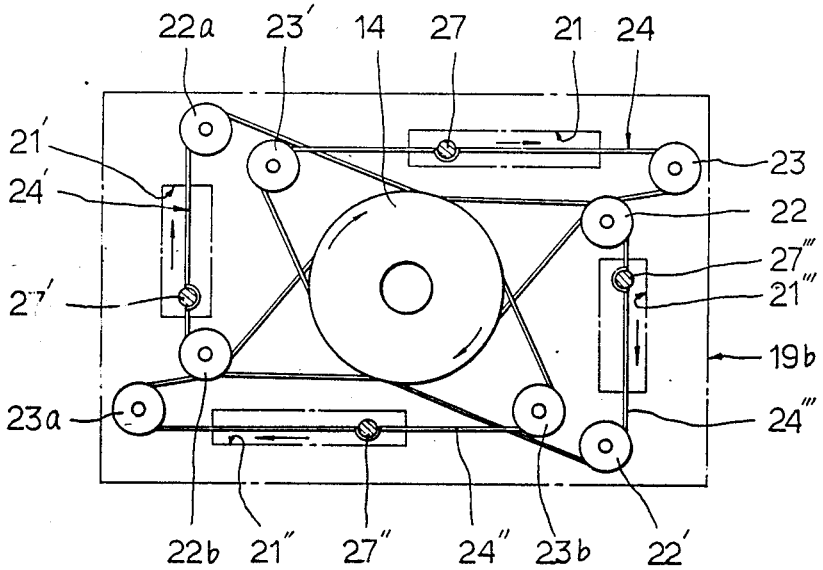
FIG. 8 is an enlarged elevation showing the manner in which the power-transmission means of the apparatus operates properly.

Referring to FIG. 5, the manner in which the apparatus according to the present invention is used is illustrated. In order to bind the box 20 with the packing cord 1O, the control lever 16 is turned clockwise (See "A" in FIG. 1) by hand and thus the pulley 14 at the end of the swivel pipe 15 rotates clockwise (See "A'" in FIG. 4). Accordingly, the steel wires 24, 24', 24'', 24''' which are hung on the upper and lower grooves of the pulley 14 move in the directions of the arrows respectively as shown in FIG. 8 and therefore, the guide pins 27, 27', 27'', 27''' that the steel wires are put through and tied up with move in the same directions as the steel wires. Thus, the support members 25, 25', 25'', 25''' are respectively made to be pushed to the outsides of the base frame 18 as shown in FIG. 1. After that, the box 20 is put on the base frame 18 as shown in FIG. 5 and one part thereof is bound together with one 25 of the support members by drawing the packing cord 10 wound on the roller 11. After the part is bound in this manner, the shaft 1 rotates clockwise (See "B " in FIG. 1 ) by means of a handle 13, causing the base frame 18 itself to rotate clockwise. When the shaft 1 has turned through an angle of 90°, part of the ball 8 built in the lateral opening 6 and urged by means of the tension spring 7, the tension of which is adjusted by an adjustment bolt 32, is made to meet with and to be inserted into another catch hole, causing the rotation of the shaft 1 to come to a stop under such a condition that the handle 13 is not turned further. Thereupon, the box 20 is also turned through an angle of 90° and another part thereof is bound with the packing cord 10 in the same manner.

Figure 9:
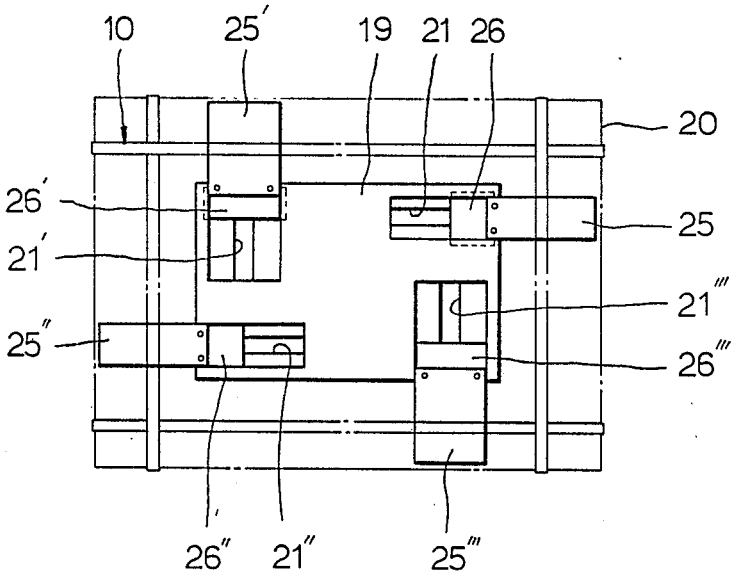
FIG. 9 is an elevation showing the manner in which the apparatus of FIG. 1 is used.

Thus, four parts of the box 20 are bound together with the support members 25, 25', 25'', 25''' as shown in FIG. 9, by repeatedly turning the base frame 18 90° by means of the handle 13 in such a manner as described hereinabove.

After such a cording work comes to an end, the control lever 16 is then turned counterclockwise so that the pulley 14 formed on the swivel pipe 15 also rotates counterclockwise. Thus, the steel wires 24, 24', 24'', 24''' move in the directions opposite to the arrows shown in FIG. 8 and accordingly, the guide pins 27, 27', 27'', 27''' also move in the same directions as the steel wires move respectively, resulting in that the support members 25, 25', 25'', 25''' are respectively pulled in and received within the guide channels 28 and 29 and thereby get free from the corded parts of the box 20. After that, the box 20 can be unloaded from the base frame 18.

Although the support members 25, 25', 25'', 25''' fall off from the corded parts of the box 20, the corded condition thereof does not become loose because the support members are relatively thin and the box 20 is usually made of paper scraps.

Figure 10:
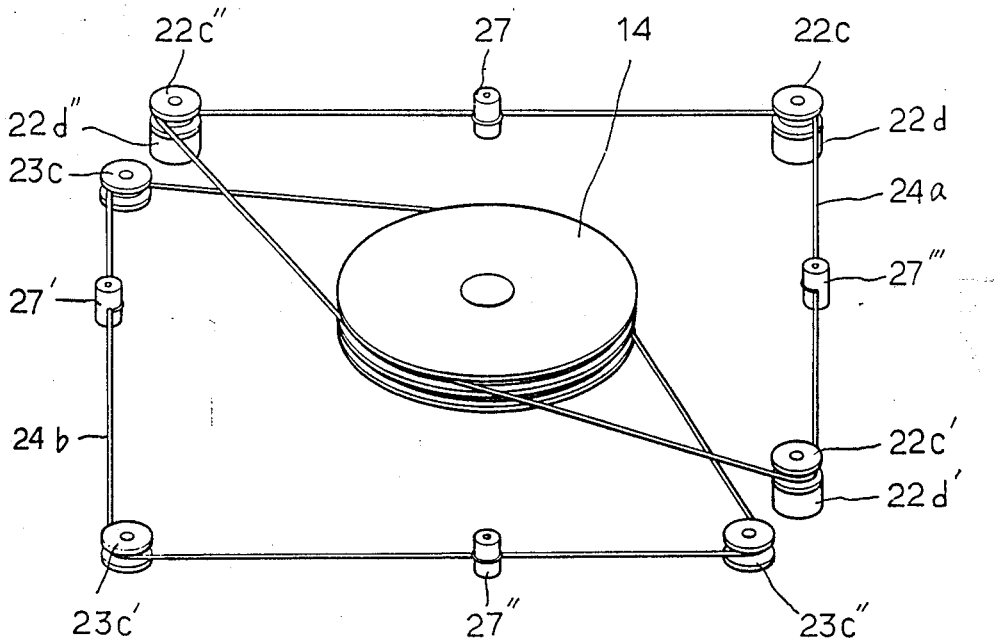
FIG. 10 is an enlarged perspective view showing another embodiment of the power-transmission means of the apparatus of FIG. 1.
Figure 11:
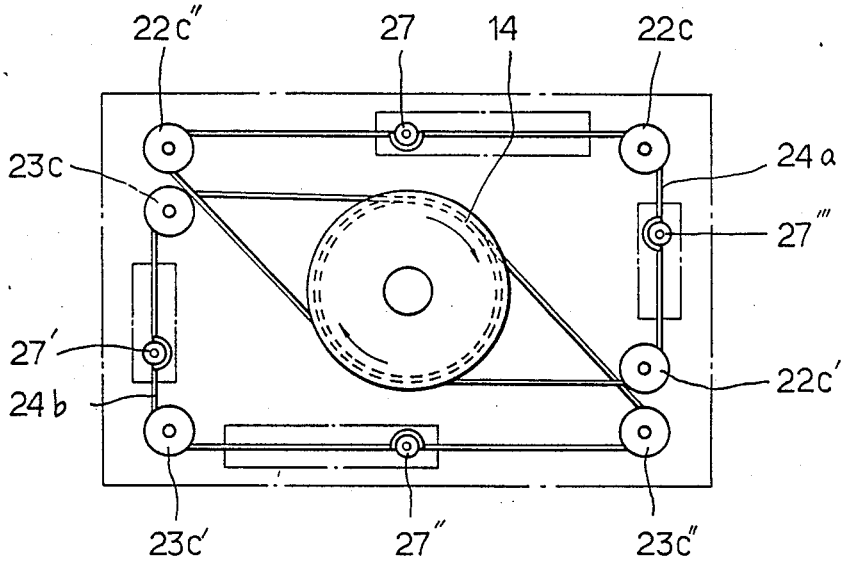
FIG. 11 is an enlarged elevation of the same embodiment of FIG. 10.

Referring now to FIGS. 10 and 11, there is illustrated another embodiment of the power-transmission means according to the present invention. In the illustrated embodiment, two guide pins 27 and 27'''connected to the guide pieces 26 and 26''' are tied up with one steel wire 24a and the other guide pins 27 and 27'' attached to the guide pieces 26' and 26'' are tied up with the other steel wire 24b.

In such a case, the structure becomes simple and a cost reduction effect is obtainable by a decrease in the number of support rollers.

Also, in this case, the support rollers 22c, 22c', 22c'' are combined with additional rollers 22d, 22d', 22d'', and thus the steel wires 24a, 24b can be kept from rubbing against each other or from being overlapped in the pulley 14 because the combined support rollers 22c, 22c', 22c'' are different in height as compared with the support rollers 23c, 23c', 23c''.

Consequently, in the preferred embodiments, the support members are firstly pushed to the outsides of the base frame by turning the control lever clockwise before the box containing an article is loaded on the base frame. Thereafter, one part of the box is bound with one of the support members by drawing the packing cord wound on the roller. Then, the other parts of the box are consecutively bound in the same manner by repeatedly turning the base frame by 90° with the handle.

After such a cording work is completed, the control lever is then turned counterclockwise and thus the support members are pulled in and completely received within the guide channels, getting free from the corded parts of the box. Then, the box can be taken down.

The reason that the support members are made to move backwards and forwards is to bind the parts of the box in a convenient manner. In other words as the sides of the box are required to come further outside than the outer side of the base frame while it is on the base frame, the base frame must be manufactured smaller than the box to be bound. Thus, when the box is loaded on the base frame which is smaller, the loaded box's condition is not stable and the box may fall through operator's carelessness. The support members can prevent the box from falling and stabilize the loading of the box.

From the foregoing, it will be apparent that the present invention provides the advantages of being specially designed to do cording work single-handed but quickly and conveniently, and reducing the cording time and manpower.

While the present invention has been described and illustrated herein with reference to the preferred embodiments thereof, it will be understood by those skilled in the art that various changes in form and details may be made therein without departing from the spirit and scope of the invention.

I claim:

1. A box-cording apparatus comprising:

frame means having a base frame on which a box to be corded is loaded and support members slidably installed on said base frame;

driving means for moving said support members back and forth;

frame rotating means having a shaft fixed to said base frame, control means for the rotation of said shaft and a base for supporting said shaft; and wherein said base frame comprises an upper base plate having a first set of guide channels formed thereon in four directions for slidably receiving said support member, a middle base plate having a second set of guide channels on which catching jaws are formed, and a lower base plate attached onto said middle base plate and having guide holes formed thereon through which guide pins are placed, said guide pins being connected to guide pieces which are fixed to said support members and slidably received within said second set of guide channels, the width of said second set of guide channels being a little larger than that of said first set thereof and both of said first and second sets thereof defining guide grooves for slidably receiving said guide pieces.

2. A box-cording apparatus as claimed in claim 1, wherein said driving means comprises a swivel pipe through which the upper part of said shaft is inserted, a control lever for turning said swivel pipe by hand, and a power-transmission means which transmits the torque of said swivel pipe and makes said support members move back and forth.

3. A box-cording apparatus comprising:

frame means having a base frame on which a box to be corded is loaded and support members slidably installed on said base frame;

driving means for moving said support members back and forth;

frame rotating means having a shaft fixed to said base frame, control means for the rotation of said shaft and a base for supporting said shaft; and wherein said driving means comprises a swivel pipe through which the upper part of said shaft is inserted, a control lever for turning said swivel pipe by hand, and power-transmission means which transmits the torque of said swivel pipe and makes said support member move back and forth, said power-transmission means comprising a double-grooves pulley formed at the upper end of said swivel pipe, eight support rollers installed to said base plate, and four steel wires hung on the upper and lower grooves of said pully via said support rollers and tied up with said guide pins respectively.

4. A box-cording apparatus comprising:

frame means having a base frame on which a box to be corded is loaded and support members slidably installed on said base frame;

driving means for moving said support members back and forth; and frame rotating means having a shaft fixed to said base frame, control means for the rotation of said shaft and a base for supporting said shaft; and wherein said driving means comprises a swivel pipe through which the upper part of said shaft is inserted, a control lever for turning said swivel pipe by hand, and power-transmission means which transmits the torque of said swivel pipe and makes said support members move back and forth, said power-transmission means comprising a double-grooved pulley formed at the upper end of said swivel pipe, two steel wires each of which is tied up with two of said guide pieces, and six support rollers, and wherein three of said support rollers are combined with additional rollers and are different in height as compared with the others of said support rollers.

5. A box-cording apparatus as claimed in claim 1, wherein said control means comprises catch holes formed on the lower circumferential surface of said shaft at regular intervals, a ball built in a lateral opening which is bored on the upper part of said base, part of said ball being inserted into one of said cat h holes, a tension spring by which said ball is urged and a tension adjustment bolt of said spring.

6. A box-cording apparatus as claimed in claim 1, wherein said base further comprises a fixing pipe to which a fixed pipe having a roller with a packing cord is firmly fixed.

* * * * *